US005207047A

United States Patent [19]

Prignitz

[11] Patent Number: 5,207,047

[45] Date of Patent: May 4, 1993

[54] METHOD AND APPARATUS FOR DISCHARGING A FOAMED MATERIAL MIXTURE, AND THE THERMAL INSULATION MATERIAL PRODUCED THEREBY

[76] Inventor: Herbert Prignitz, Papyrusweg 12, D-2000 Hamburg 74, Fed. Rep. of Germany

[21] Appl. No.: 613,521

[22] PCT Filed: Apr. 28, 1989

[86] PCT No.: PCT/EP89/00471

§ 371 Date: Nov. 13, 1990

§ 102(e) Date: Nov. 13, 1990

[87] PCT Pub. No.: WO89/10826

PCT Pub. Date: Nov. 16, 1989

[30] Foreign Application Priority Data

May 11, 1988 [DE] Fed. Rep. of Germany ... 8806267[U]

[51] Int. Cl.[5] ..... E04B 1/62

[52] U.S. Cl. ..... 52/743; 52/309.4; 52/309.8; 52/309.9; 52/408

[58] Field of Search ..... 52/309.4, 309.8, 309.9, 52/408, 743

[56] References Cited

U.S. PATENT DOCUMENTS

| | | | |
|---|---|---|---|
| 2,576,073 | 11/1951 | Kropa et al. | 52/309.7 |
| 3,092,469 | 4/1959 | Jaffe . | |
| 3,111,389 | 10/1959 | Hansen . | |
| 3,455,076 | 7/1969 | Clarvoe | 52/309.8 |
| 3,466,222 | 9/1969 | Curtis | 52/309.8 |
| 3,496,058 | 2/1970 | Schrotur et al. . | |
| 3,557,840 | 1/1971 | Maybee . | |
| 3,626,044 | 12/1971 | Arnaud . | |
| 3,969,868 | 7/1976 | Bainter et al. | 52/631 |
| 3,979,245 | 9/1976 | Bondra . | |
| 4,361,995 | 12/1982 | Buck et al. | 52/631 |
| 4,401,706 | 8/1983 | Sovilla . | |
| 4,977,711 | 12/1990 | Prignitz | 52/309.11 |

FOREIGN PATENT DOCUMENTS

| | | |
|---|---|---|
| 2322716 | 11/1974 | Fed. Rep. of Germany . |
| 2519484 | 11/1976 | Fed. Rep. of Germany . |
| 2725937 | 12/1978 | Fed. Rep. of Germany . |
| 3300755 | 3/1984 | Fed. Rep. of Germany . |
| 8519811 | 8/1985 | Fed. Rep. of Germany . |
| 8604889 | 5/1986 | Fed. Rep. of Germany . |
| 8514452 | 9/1986 | Fed. Rep. of Germany . |
| 2310376 | 1/1977 | France . |
| 1103551 | 2/1968 | United Kingdom . |
| 1521425 | 8/1978 | United Kingdom . |

*Primary Examiner*—David A. Scherbel
*Assistant Examiner*—Wynn E. Wood

[57] ABSTRACT

In order to provide a method for the discharge of a mixture of foamed material, more particularly for a thermal insulating material, by means of a mixing head for at least two reactive compounding ingredients in the low-pressure process, comprising a tube in which an agitator rotates at high speed, a mixing head for performing the method and an insulating material fabricated according to the method is proposed according to which the mixture ready for reaction is discharged by centrifugal force and distributed onto a substrate, in order to fully react and foam thereon, and a mixing head for performing the method. A thermal insulating material fabricated hereby is characterized in that the insulating materials are laminated onto a carrier web in the form of a sealing layer and in that the strips of insulating material possess a cuneiform cross-section.

20 Claims, 4 Drawing Sheets

METHOD AND APPARATUS FOR DISCHARGING A FOAMED MATERIAL MIXTURE, AND THE THERMAL INSULATION MATERIAL PRODUCED THEREBY

SCOPE OF APPLICATION

The method, the appropriate mixing head and also the thusly fabricated insulating material can be employed wherever insulating material is produced and employed with which it is intended to provide larger roof areas in order to form an insulating and sealing layer.

The present invention relates to a method of discharging a mixture of foamed material, more particularly for a thermal insulating material, by means of a mixing head for at least two reactive compounding ingredients in the low-pressure process, consisting of a tube, inside which an agitator rotates at high speed, a mixing head for performing the method and an insulating material fabricated according to the method.

STATE OF THE ART

Mixing heads for polyurethane mixtures of foamed materials produced in the low pressure process are known. In order to distribute the material with the aid of a mixing head onto a substrate passed through underneath the mixing head, the most widely varying methods and means are employed which are subject to a great many shortcomings. Due to the high viscosity of the foamed material mixture, not even the reciprocal travel of the mixing head transversally to the direction of passage suffices to achieve the desired run of the foamed material mixture. By way of example, fish tail-shaped discharge nozzles are used. Also employed are small bore tubes, in which case the mixture is discharged with the aid of compressed air. All these forms of discharging the mixture of foamed materials subsequent to the mixing operation call for a substantial effort and do not result in the desired success of are, as e.g. the discharge effected by compressed air, hazardous to health.

Thus, from the U.S. Pat. No. 3,111,389, a method for the discharge of a foamed material mixture, more particularly for a thermal insulating material, is known in which, with the aid of a mixing head for at least two reactive compounding ingredients in the low-pressure process, consisting of a tube inside which an agitator rotates at high speed, the material readily for reaction is discharged by centrifugal, force and distributed onto a substrate in order to completely react and foam there.

The DE-OS 27 25 937 shows a rollable web of thermal insulating material comprising an insulating layer of foamed plastic material with transversally proceeding notches and a waterproof covering web attached thereupon on one side which, by preference, is bonded on, in which the insulating layer of foamed plastic material tapers between two oppositely located edges of the rectangular thermal insulating web so that the insulating strips have a wedge-shaped cross-section.

From the DE-GM 85 14 452.5, a polymer bitumen sealing web for the covering of roofs is known in which a substrate of glass fabric, non-woven or the like with an impregnation with polymeric bitumen and a sealing layer of polymeric bitumen is present, in which provision is made for the sealing layer to be constructed on its underside in the form of a separating and (vapor pressure) compensating layer, the compensating layer comprising a channel system which is made up of reciprocally crossing longitudinal and transversal grooves. Provision may also be made for the compensating layer to be constructed of stud-like projections.

OBJECT, SOLUTION, ADVANTAGES

That is why it is the object of the present invention to provide a method of the kind stated in the beginning and a device for this in which these disadvantages no longer exist and with the aid of which the discharge of foamed materials can be effected without fluctuations in quality, without interruptions due to arising preparation time and in a manner adaptable to all requirements.

For solving this technical problem, a method of the kind stated in the beginning is proposed, in accordance with which only one compounding ingredient of materials which do not react by themselves, near an external bearing of a floating shaft upon which an agitator is mounted, in the proximity of the shaft, is introduced into a mixing space and, by the action of centrifugal force, conveyed on further by the same so as to only then come to be intermixed with a further compounding ingredient which reacts with the compounding ingredient charged first so that the bearing, in order to avoid premature reaction, contaminations, heating or damage to the bearing, does not come in mutual contact with the materials reacting with each other.

The method proposed renders a uniform distribution of the foaming materials mixture on the substrate possible even when the mixture of foamed material is highly viscous and at the lowest throughput in the simplest manner while avoiding the disadvantages stated.

An appropriate mixing head for performing the method which is disposed within a machine frame and the mixing head itself comprises a casing-like mixing tube which, at its upper end located opposite its lower end in which the discharge aperture is constructed, is provided with a cover-like sealing body, is, according to the invention, constructed in such a way that, in the sealing body, a bearing is mounted, in which a shaft which is drivable by a drive means is floating supported, upon which an agitator body extending as far as into the area of the discharge aperture is mounted, said shaft being constructed so as to extend all the way through the entire mixing tube, in which, underneath the bearing, while forming a gap-like interspace, the cylinder-like agitator body is mounted on the shaft, in that the sealing body, a first feeder channel terminating in the interspace is constructed, and in that, in the mixing tube, a second feeder channel terminating in a mixing space provided between the mixing tube inner wall and the agitator surface is constructed.

If, for instance, larger or smaller widths of the foamed material strand are to be produced on a laminating machine, then this can be achieved by the vertical adjustment of the mixing head, in which case the cone of the mixture to be applied and formed by the centrifugal force, accordingly covers a smaller or larger area.

It is also possible to obtain a different thickness of the foamed material coating transversally to the direction of travel, as is necessary e.g. for the manufacture of sloping panels, by an inclination by a few degrees from the vertical and a slight displacement in the horizontal of the mixing head.

If larger widths of application become necessary (e.g. in excess of 1000 mm), then it is possible to dispose two mixing heads side by side without allowing the mixing head to oscillate transversally to the direction of travel of the substrate.

By conveying the one compounding ingredient of the foamed material which does not react with itself into the proximity of the outer bearing of the mixing head and the shaft by centrifuging within the mixing space so as to permit it only there to come into contact with the compounding ingredient with which the reaction takes place, a contamination of the bearing is avoided and the entire mixing head is kept operable for a continuous operation.

The casing grooves of the agitator which interrupt the screw channels and bring about a subsequent mixing are expediently not to be constructed so as to reach the end of the agitator. It is avoided thereby that, when the conveyor screw channels are not filled completely due to a high speed or a lower material throughput, mixed material about to come to reaction or air reaches the lower portion of the agitator and a contamination is prevented here as well.

Preferring further developments of the device are characterized in the claims 2 to 12. With such a device it is possible to provide a thermal insulating material to be employed as insulating and sealing layer for roof areas which make it possible to simultaneously cover larger areas of several square meters, the material consisting of strips of insulating material bonded or laminated onto a substrate.

In the case of flat roofs, especially in the case of so-called non-insulated roofs, it is known to apply the roof sealing in several layers onto the insulation. The manufacturers of insulating material have attempted to simplify this multiple-layer application in that insulating elements having the normal dimension of 1 m×0.5 m were provided with a single sealing layer with an overlap projecting on two sides to be bonded onto already laid material consisting of already applied insulating elements. It was intended to thereby simplify the entire roofing operation and to have the insulating material protected against atmospheric influences and exposure immediately subsequent to the laying. It was still necessary then to apply the actual sealing layers (at least one) because, due to the application of the elements, overlaps were produced which were too short, which gave rise to the fear that humidity would penetrate from the outside.

For the sake of a further simplification and for the sake of a faster sequence of operations, web rolls were produced that consisted of a correspondingly wide sealing web having a length of up to 10 m, which were bonded onto the strips of foamed material, which made it possible to roll up the same so as to form webs of up to 10 m in length. These web rolls have a width of up to 1 m and, with a length of 5 m, cover a roof area of 5 $m^2$ in one operation. 5 m was the required minimum length in order to avoid excessively short overlaps of the elements.

These web rolls made it possible for the strips of insulating material to be rolled up to form a larger unit for covering larger areas. Normal bituminous roofing webs are employed in this case as sealing webs. However, when unrolled, the same had buckling creases in the carrier web so that good cause existed to fear leaks in the finished flat roof. That is why, in addition, several, but at least one additional roofing web had to be applied.

Even today, when flat roofs having a slope of 3% or more are involved, the laying of at least two sealing layers on one thermal insulation layer is necessary. If the slope is less than 3% or even zero, three sealing webs or bituminous sheets on the thermal insulation layer are regarded as being in keeping with a workmanlike finish. Even the very highly developed plastic sheets of today which are admitted in single layers on roofs having a zero slope, require, as a guarantee on a thermal insulation layer, one additional substrate web for the protection of the laid sheeting at the joints of the thermal insulation against damage and the migration of e.g. plasticizers from the sealing of the sheet. However, the carrier web located on a web roll, irrespective of the type, is recognized as a protection of the sheet.

A further significant disadvantage in the multiple-layer roof sealing is the feared bubble formation on the flat roof. This is caused by non-bonded points between the sealing layers. The slightest inclusion of moisture when the sealing layers are superposed or placed onto the thermal insulating material, results in unbonded points and, thereby, in the inevitable formation of bubbles or blisters.

This bubble formation is often attributed to the vapor pressure apparently generated, e.g. due to solar irradiation. However, a vapor pressure above atmospheric can only be produced at 100° and above. But the bubble formation in coating layers is only possible by the volume enlargement of the entrapped air at the non-bonded points according to the law of Gay-Lissac. According to this law, the air volumes behave like the absolute temperatures. That is why a distension of the air between the individual sealing layers is unavoidable when the connection between the individual sealing layers by relevant bonding or welding is not established in such a way that several layers become one and a perfect connection comes about. But this is quite impossible. Matters have improved due to the use of sealing or welding webs, in which case the two joined webs are fused together. The bubble formation can thus be avoided only when the layers or sealing layers are laid on top of each other so as to form one whole.

In addition, a further requirement arises today. In the case of flat roofs, an ever-increasing demand exits, be it in new buildings or in the redevelopment of old ones, that no water be left standing on the roof after a rainfall. Consequently, more and more sloping roofs are constructed.

This is done in a conventional manner, in new buildings in many instances by the application of a sloping coating, either in heavy concrete or by means of a light-weight concrete. With this, the slope is provided and no further consideration is required when applying the thermal insulating material and the sealing.

If this is not the case, then the thermal insulating material is mostly supplied in wedge shape and this very largely in polystyrene. Various demands are made on the slope, in particular within the range of from 1% to 3%. This is done for the most part according to previously produced drawings in which the entire slope is then produced at the works in any form whatever, either by cutting or by the construction of individual pieces. It would therefore be desirable to provide a thermal insulating material which, due to a web-like construction, enables larger surface elements of the material to be manufactured in one operation and to cover larger areas of several square meters at once.

It is desirable to provide a thermal insulating material and sealing layer for roof areas which can be employed as the sole roofing element for the roof areas, which can be laid on larger areas and which can also be used for the construction of a roof slope without the previous application of a slope piece, in which the disadvantages of the known solution, such as the trimming waste or the necessity of individual construction or the formation of buckling creases and the bubble formation are avoidable.

Above all, with the method and the device it is specifically possible to provide a thermal insulating material as an insulating and sealing layer in that the strips of insulating material are laminated onto a suitable sheet web as a sealing layer in such a way that the thermal insulating material is constructed so as to form a thermal insulating and sealing layer so that, once it is laid, no need exists for applying a further sealing layer and in that the strips of insulating material possess a rectangular or cuneiform cross-section.

By preference, provision is made in this case for the angle of inclination of the wedge shape transversally to the longitudinal direction of the web roll to correspond to a gradient of 1%, 2% or 3%.

With such a thermal insulating material it is possible to provide a roof area with the requisite thermal insulation and sealing layer without is being necessary for an additional sealing web to be applied. It is possible to achieve quite a decisive saving in both labor and material thereby, while at the same time the quality of the roofing improves since, due to the reduction in the craftsmen's activity, a reduction in the possibility of errors in achieved.

According to a preferred embodiment, provision is made in this case for the laminating material to consist of a plastic sheet while, according to another preferred embodiment, the laminating material is comprised of a metal foil. What is essential in this case is that it is ensured by such laminating materials that the thermal insulating material is applied to the roof area in such a way that an appropriate thermal insulation is produced, on which, at the same time, a sealing layer is disposed which is connectable without difficulty within the overlap areas so that the insulating material is protected against atmospheric influences after laying. In this case the insulating material may, according to a preferred embodiment, be comprised of polyurethane strips, while according to another preferred embodiment, provision has been made for foamed polystyrene particles or extruded polystyrene to be employed as insulating material. This construction of the strips of insulating material in the form of hard foamed material bodies results in an optimal thermal insulation, in which case provision is preferably made for the insulating material to be fabricated and/or applied in such a way that the strips of insulating material, in the laid state, are located side by side without any gaps therebetween.

In this case provision may be made for the insulating material to be provided with diffusion channels on its surface located opposite the lamination. These may be constructed in that, on the surface located opposite the lamination, projections are provided in a regular arrangement which possess a spherical, a rib-like, a frusto-conical configuration or some other geometrical form.

In order to increase the inherent stability of the thermal insulating material, especially in order to satisfy the most exacting requirements, provision may preferably be made for the insulating material and/or the laminating material to be provided with a stabilizing or reinforcing fabric.

Advantageous and expedient embodiments of the invention are characterized in the subclaims.

BRIEF DESCRIPTION OF THE DRAWINGS

Embodiments of the invention are explained below with the aid of the drawings. Thus

DETAILED DESCRIPTION OF THE INVENTION AND THE BEST WAY OF PERFORMING THE INVENTION

Figure 1:
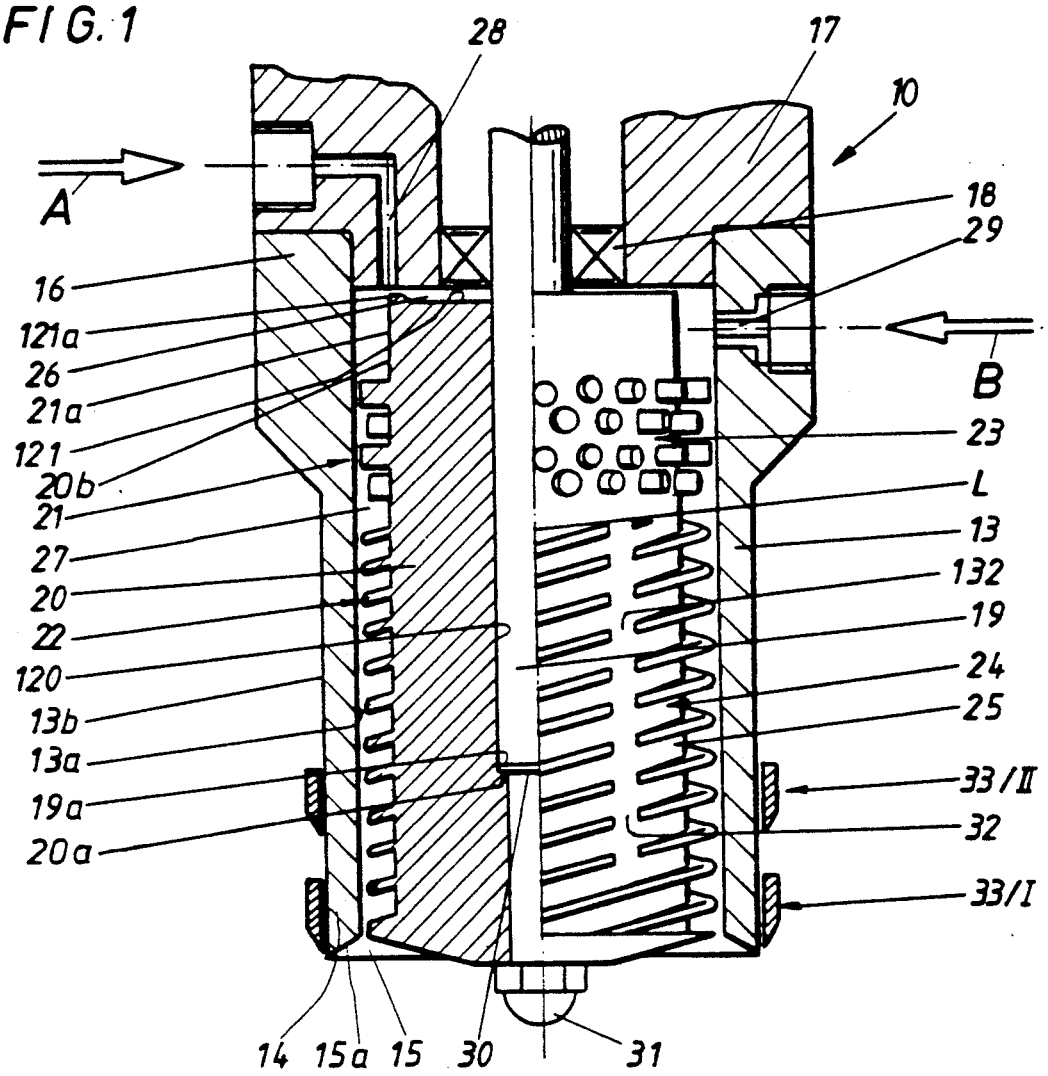
FIG. 1 shows, in a vertical section, a diagrammatical representation of a mixing head.
Figure 2:
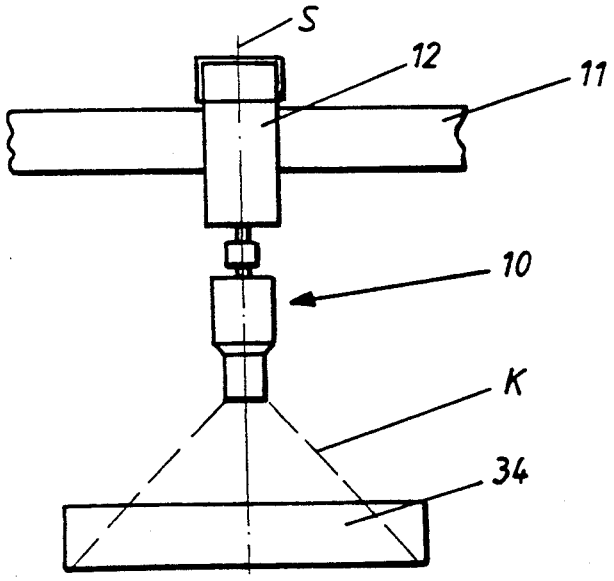
FIG. 2 shows, in a diagrammatical representation, the mixing head according to FIG. 1 with a drive means within an indicated machine frame with an indicated discharge of foamed material.
Figure 3:
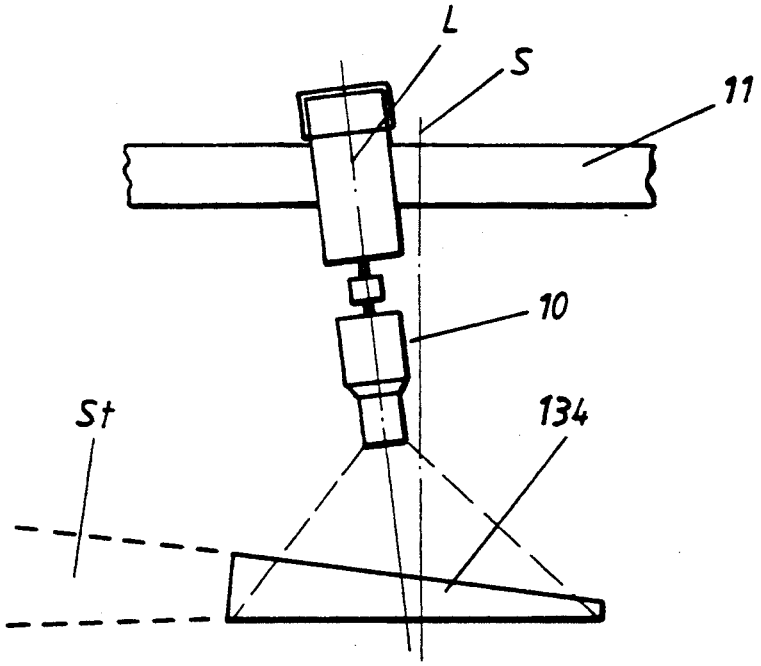
FIG. 3 shows the assembly according to FIG. 2 with the laterally displaced mixing head swivelled out of the vertical.

In the FIGS. 1 to 3, a mixing head is depicted for discharging a mixture foamed material consisting of compounding ingredients A and B not shown in the drawings. Such a mixing head is mounted within a machine frame 11 and is driven by a drive means 12, while the compounding ingredients A and B are supplied via feeder lines which are not shown.

The mixing head 10 consists of a mixing tube 13 which forms the discharge aperture 15 at its lower end 14, while the upper end 16 is closed with the sealing body, to which the mixing tube 13 is secured.

Within the area of the discharge aperture 15, the mixing tube 13 is provided with a chamfer **15*a*** which imparts a specific discharge cone K to the foamed material comprising the mixed compounding ingredients A and B.

Within the sealing body 17 which is secured in a torsionally resistant manner to the drive means 12, a bearing 18 is disposed in which a floating shaft 19 is supported. Underneath the bearing 18, the shaft 19 carries the agitator body 20 while the shaft 19 and the agitator body 20 extend as far as into the area of the discharge aperture 15 of the mixing tube 13. In this case, the agitator body 20 is provided with a longitudinal drilled hole 120 with which it is mounted onto the shaft 19. The shaft 19 is in this case provided with a shoulder **10*a*, while the longitudinal drilled hole 120 is provided with a step 20*a* in such a way that the agitator body 20 can be pushed onto the shaft 19 up to the limit stop formed by the shoulder 19*a* and the step 20*a***.

The agitator body itself which is constructed in the form of a cylinder has two sections 21,22, the upper section 21 being provided with mandrels 23 disposed on the surface **20*b* of the agitator body 20 and possesses e.g. a frusto-cylindrical configuration, while the second section 22 is constructed in the form of a conveyor screw 24 for conveying the material A, B through the screw channels 25 of the conveyor screw 24**.

Between the disk-shaped upper terminal surface 121 of the agitator body 20 which is provided with a rotating outer rim **121*a* projecting in the longitudinal direction L of the shaft, and the oppositely arranged sealing body 17 supporting the bearing 18, a gap-like interspace 26 is constructed in which, a first feeder channel terminating within the area of the gap-like interspace 26 and/or the rotating rim 121***a* delimiting the latter is constructed in the sealing body 17, through which the compounding ingredient A can be supplied to this area. Underneath the rotating rim 121*a*, on the surface 20*b* of the agitator body 20, before the beginning of section 21 which bears the mandrels, a mandrel-free area 21*a* is constructed which has a distance from the inner wall 13*a* of the mixing tube 13 that is predetermined by the height of the mandrels 23 and which forms a first mixing space 27. Into the same, due to the centrifugal force, the compounding ingredient A charged into the gap-like interspace 26 is transferred. At the same time, a second feeder channel 29 terminates within the area of the mixing space 27 on the inner wall 13*a* of the mixing tube 13 for supplying the compounding ingredient B. That is why the compounding ingredients A and b are intermixed within the mixing space 27, the actual mixing being brought about by the mandrels 23. Since the compounding ingredients A and B are supplied in a pressurized state via the feeder channels 28, 29, the compound ingredient mixture produced in the mixing space 27 and mixed thoroughly be the mandrels 23, is conveyed into the area of the conveyor screw 24 and received by the screw channels 25.

In adaptation to the various factors and influence values as well as to the compounding ingredients A and B, the spatial size of the gap-like interspace can be adjusted or altered in that one or more disks 30 having the same or varying thickness can be pushed onto the shaft 10 and brought up to the shoulder 19*a* prior to the mounting of the agitator body 20 and screwed tight by means of the nut 31 of shaft 19. By the step 20*a* coming to abut against the disks 30, a longitudinal displacement of the agitator body is achieved so that the size of the gap-like interspace 26 is adjusted so as to be accordingly enlarged.

A number of the screw channels 25 of the conveyor screw 24 are connected by interruptions 132 in the screw 24 so that one or several connections extending in the longitudinal direction L of the shaft between the screw channels 25 of the conveyor screw 24 result. These may also be constructed in the form of casing grooves 32. In this case, provision is also made for the screw channels 25, within the area of the discharge aperture 15, not to be connected by interruptions 132 or by casing grooves 32.

On its outer wall 13*b*, the mixing tube 13 is, within the discharge aperture area 15, provided with a ring that embraces the mixing tube 13 in the form of a wiper 33. The wiper 33 is displaceably mounted on the mixing tube 13 or on the outer wall 13*b* of the mixing tube 13 in the longitudinal direction L of the shaft, while on the drawing, at I., a working position of the wiper 33 and at II., a rest position of the wiper 33 is depicted.

As shown in the FIG. 2, the mixed and reacting compounding ingredients A and B of the foamed material mixture are discharged by the interaction of the agitator 20, the centrifugal forces generated and the chamfer 15*a* in the form of a discharge cone K. A discharge results hereby of the material located or moved underneath the mixing head 10, it being also possible for the chamfer 15*a* to be provided with a radius so that the issuing material forms a steeper dispersion cone K. The approximately rectangular foam discharge is indicated with 34, which results when the mixing head 10 assumes the position depicted in the FIG. 2. When the mixing head, as is shown in the FIG. 3, is swivelled out in the longitudinal direction of the shaft through an angle with respect to the vertical and is laterally displaced, a rising foam 134 results which possesses a gradient St, as is also indicated in the FIG. 3. It is possible to hereby construct the foamed materials and, more particularly, strips of insulating material which possess a cuneiform cross-section.

The mixing head described in the foregoing which, in principle, constitutes the device for performing the novel method, is not restricted to the embodiments described in the foregoing and depicted in the drawings. Changes in the type of the mixing members on the surface of the agitator as well as in the construction of the discharge aperture come under the scope of the invention just like another type of adjustment device when the fundamental technical teaching is realized, which consists in that the compounding ingredients A and B are first of all supplied separately to the mixing head and mixed within a space insusceptible to contaminations.

Figure 4:
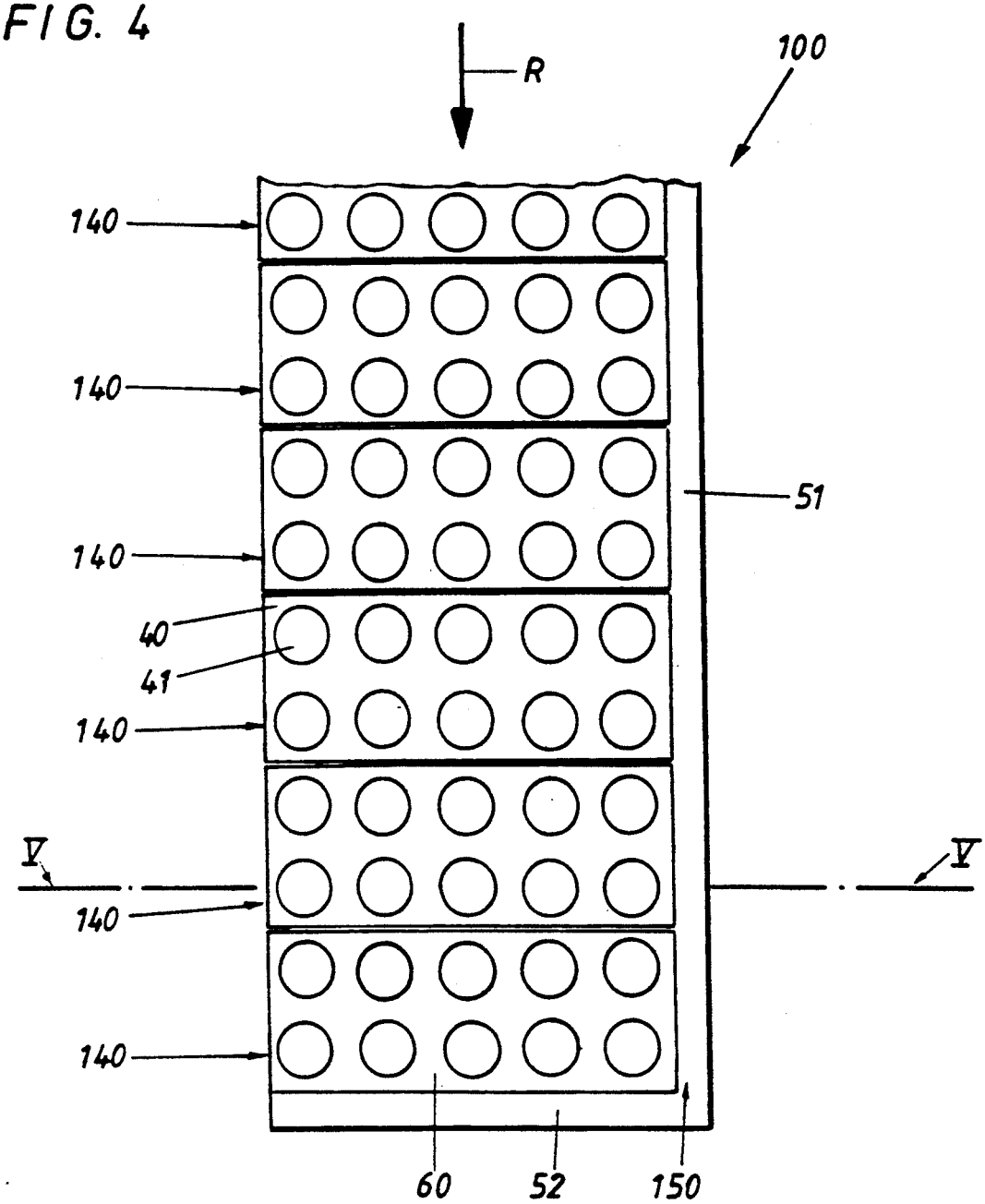
FIG. 4 shows, in a view from below, a section of thermal insulating material.
Figure 5:
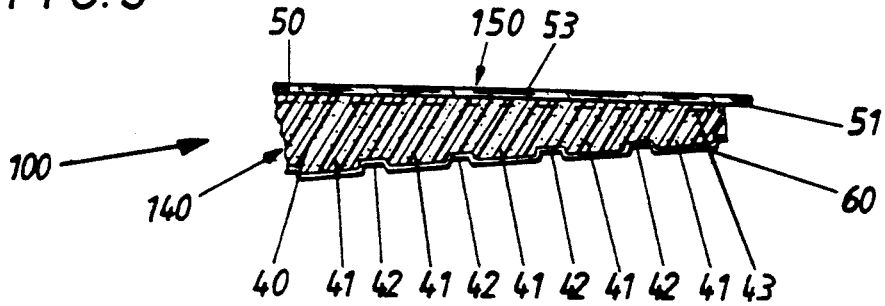
FIG. 5 shows, in a vertical section in the direction of Line V—V in FIG. 4, the thermal insulating material.
Figure 6:
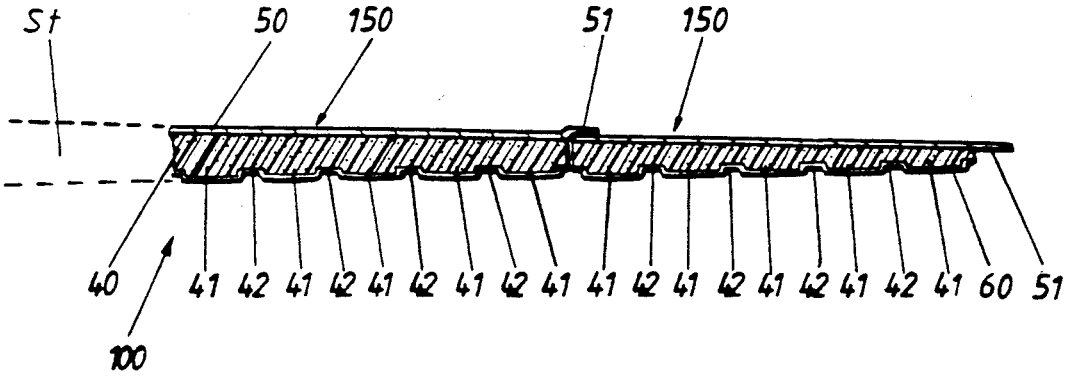
FIG. 6 shows, the thermal insulating material in the side-by-side arrangement projected for a flat roof for forming a slope.

In the FIGS. 4 to 6, an accordingly fabricated thermal insulating material is identified with 100, which consists of the sheet web 150 as sealing layer and the strips of insulating material 140 placed thereupon as insulating material 40. In this case, the sheet web 150, in comparison with the strips of insulating material 140, are provided with projecting edges which serve as overlap sections 51, 52 and which are disposed on a longitudinal and a transversal edge, respectively. In a side-by-side arrangement of the thermal insulating material web (depicted in FIG. 6), appropriate overlap sections 51, 52 can be placed upon the already laid insulation webs and be welded to each other so that a secure protection against atmospheric influences is provided. The strips of insulating material 140 consist in this case of the insulating material 40, for which polyurethane or polystyrene can be selected. The employment of glass fiber and rock wool strips is also possible. Provision may be made in this case for the insulating material 40 to be provided with a stabilizing fabric 43.

In addition, on the side which faces away from the sheet web 150 of the strips of insulating material 140, spherical projections 41 in regular disposition are provided for the construction of diffusion channels 42. These are constructed in the form of flat prominences, while it is possible to also provide any other suitable configuration and disposition by means of which it is ensured that, between the roof to be covered and the insulation material 100, a dehumification zone is created in which a partial pressure ratio then results which, on account of its relationship with the partial pressure ratio of the ambient atmosphere, leads to an evacuation of the humidity from the surface of the building.

By means of the depicted assembly, particularly wide and regular vapor expansion paths are provided which ensure a certain dehumification. In this case, metal foil 60 is bonded onto the insulating material 40 on the surface located opposite the single-layer sealing layer lamination 50, while the lamination material is constructed in the form of plastic sheet, metal foil, welding web or bituminous sealing web.

The insulating material 40 or the strips of insulating material 140 possess, in the longitudinal direction of the web, a uniform cross-section which, in the transversal direction of the web, is rising in a cuneiform manner. In order to form a suitable slope, a gradient, of 1% 2% or 3% is produced, it is also possible to provide required intermediate values.

The sealing layer lamination 50 may consist of a material reinforced by a fabric 53 or of a non-woven pressed into a plastic sheet, in which case provision may be made for the sealing layer lamination 50, for the sake of a better adhesion of the insulating material strips 140, to be provided on its surface with a non-woven or a fabric of polyester or glass fibers or of organic fibers, such as jute or the like.

By preference, the strips of insulating material 140 are bonded on in the form of a strand in a laminating machine and are subsequently formed into cut insulating material 40, it being possible to provide in this case for the insulating material 40 to be fabricated in panels and that, when the strips of insulating material are cut, the panels are not cut right through so that a connection of the strips of insulating material still exists for bonding on in large areas.

I claim:

1. A method for discharging a foamed material, more particularly a heat insulating material, with the aid of a mixing head for mixing at least two reactive constituents in a low pressure process, which mixing head is comprised of a pipe in which an agitator rotates at a high speed of rotation and from which mixing head the mixture ready for reaction in discharged by gravity and distributed onto a substrate in order to fully react and foam up there, characterized in that the ready mixture, in addition to being discharged by gravity, is discharged with the aid of centrifugal force, and in that only one (A) of said two reactive constituents, which one constituent (A) is comprised of materials which do not react on their own, is first introduced into a space within said mixing head located in the vicinity of an outer bearing of a floating shaft upon which said agitator is mounted and is then conveyed by the action of centrifugal force to another location within said mixing head at which it only then becomes intermixed with the other (B) of said two reactive constituents in order to prevent premature reactions occurring in the vicinity of said bearing and so that said bearing does not come into contact with the interreacting constituents (A and B) and is thereby protected against contamination, heating or damage by said interreacting constituents.

2. Mixing head for performing the method according to claim 1, in which the mixing head (10) is disposed within a machine frame (11) and in that the mixing head (10) is comprised of a casing-like mixing tube (13) which, on its upper end (16) opposite its lower end (14) provided with the discharge aperture (15), h as a cover-like sealing body (17), characterized in that, within the sealing body (17), a bearing (18) is disposed, in which a shaft (19) drivable by a drive means (12) if floatingly supported, upon which an agitator body (20) is mounted which extends as far as into the discharge aperture area (15), said shaft being constructed so as to extend through the entire mixing tube (13), in which, underneath the bearing (18), while forming a gap-like interspace (26), the agitator body constructed in the form of a cylinder (20) is mounted on the shaft, in that, in the sealing body (17), a first feeder channel (28) is constructed and in that, in the mixing tube (13), a second feeder channel (29) is constructed which terminates in a mixing space (27) constructed between the inner wall (13*a*) of the mixing tube and the agitator surface (20*b*).

3. Mixing head according to claim 2, characterized in that the agitator body (20), on its surface (20*b*), in a first section (21), is provided with several rows of mandrels (23) and, in a second section (22), with a conveyor screw (24) for the discharge of the mixed materials (A, B).

4. Mixing head according to claim 3, characterized in that the gap-like interspace (26) from which the compounding ingredient (A) supplied via the first feeder channel (28) is removed by centrifuging, is vertically variable by the disposition of interchangeable disks (30) of various thicknesses between a shaft shoulder (19*a*) of the shaft (19) and a corresponding step (20*a*) in the longitudinal bore (120) of the agitator body (20).

5. Mixing head according to claim 2, characterized in that the mixing tube (13) in which the agitator (20) rotates, is provided with a chamfer (15*a*) at the discharge aperture (15), which imparts to the material comprising the mixed compounding ingredients (A, B) a specific discharge cone (K).

6. Mixing head according to claim 2, characterized in that the speed of the drive means (12) is controllable.

7. Mixing head according to claim 6, characterized in that the frequency of the drive means (12) is controlled.

8. Mixing head according to claim 2, characterized in that the screw (24) on the surface (20*b*) of the agitator body (20) is constructed so as to possess several channels.

9. Mixing head according to claim 2, characterized in that the screw channels (25) rotating helically on the surface (20*b*) of the agitator body (20), are interconnected at least in part by a number of casing grooves (32) disposed so as to be spaced apart from each other and extending in the longitudinal direction (L) of the shaft.

10. Mixing head according to claim 9, characterized in that the casing grooves (32) on the surface (20*b*) of the agitator body (20) do not extend as far as to the end of the agitator (20) on the discharge aperture side and in that the screw channels (25) of the screw (24) located within the area of the discharge aperture (16) are not connected by casing grooves.

11. Mixing head according to claim 2, characterized in that the mixing head (10) is disposed within the machine frame (11) from the vertical (S), perpendicularly to the longitudinal direction (L) of the shaft so as to be laterally and vertically adjustable.

12. Mixing head according to claim 2, characterized in that the outer wall (13*b*) of the mixing tube (13) is provided with a ring that embraces the mixing tube (13) in the form of a wiper (33), which is displaceable in the longitudinal direction (L) of the shaft relative to the mixing tube (13).

13. Thermal insulating material comprised of stripe of insulating material of a mixture of foamed material discharged according to the method as per claim 1, and bonded onto a substrate, characterized in that, for the construction of a thermal insulating material in the form of an insulating and sealing layer for roof areas which makes it possible to cover larger areas of several square meters at once, the strips of insulating material (140) being laminated onto a suitable sheet web as sealing layer (150) in such a way that, when it is laid, no need exists for the application of an additional sealing web, in which the laminated material (50) is comprised of a plastic sheet, a metal foil of a bituminous sealing web, the strips of insulating material (140) are made up of strips of polyurethane, foamed polystyrene particles or of extruded polystyrene, and the strips of insulating material (140) are constructed as insulating material (40) coated on in a laminating machine in the form of a strand and are subsequently cut, or the insulating material (40) is coated on in a cut form, and in that the strips of insulating material (140) have a rectangular of cuneiform cross-section.

14. Thermal insulating material according to claim 13, characterized in that the angle of inclination of the wedge shape transversally to the longitudinal direction of the web roll (R) corresponds to a gradient (St) of 1%, 2% or 3%.

15. Thermal insulating material according to claim 13, characterized in that the insulating material (40) is provided with a stabilizing fabric (43).

16. Thermal insulating material according to any of claims 13 to 15, characterized in that, into the insulating material (40), on the area located opposite the single-layer laminated material (50), diffusion channels (42) are incorporated.

17. Thermal insulating material according to claim 13, characterized in that, onto the insulating material (40), within the area located opposite the single-layer sealing layer laminated material (50), a metal foil (60) is bonded on.

18. Thermal material according to claim 13, characterized in that the sealing layer laminated material (50) is comprised of a material reinforced by a fabric (53) or of a non-woven pressed into a plastic sheet.

19. Thermal insulating material according to claim 13, characterized in that the insulating material (40) is fabricated in panels and in that, when the strips of insulating material (140) are cut, said panels are not cut right through so that a connection of the strips of insulating material (140) still remains for being laminated within larger areas.

20. Thermal insulating material according to claim 13, characterized in that the sealing layer laminated material (50), in order to provide a better adhesion of the strips of insulating material (140), is provided on the surface with a non-woven or with a fabric of polyester of glass fibers or of organic fibers, such as jute.

* * * * *